US005579707A

United States Patent [19]

Erwin

[11] Patent Number: 5,579,707

[45] Date of Patent: Dec. 3, 1996

[54] DOUBLE HEM APPARATUS AND METHOD

[75] Inventor: William P. Erwin, Kannapolis, N.C.

[73] Assignee: Fieldcrest Cannon, Inc., Eden, N.C.

[21] Appl. No.: 519,964

[22] Filed: Aug. 28, 1995

[51] Int. Cl.[6] ..... D05B 35/02

[52] U.S. Cl. ..... 112/141

[58] Field of Search ..... 112/141, 136, 112/138, 141, 142, 147, 153, 149, 144; 270/32, 37

[56] References Cited

U.S. PATENT DOCUMENTS 1,826,677 10/1931 Sailer ..... 112/141
2,034,672 3/1936 Ackerman ..... 112/141
2,138,633 11/1938 Greenfield et al. ..... 112/141
2,642,827 6/1953 Sherman ..... 112/141

*Primary Examiner*—Ismael Izaguirre
*Attorney, Agent, or Firm*—Bell, Seltzer, Park & Gibson, P.A.

[57] ABSTRACT

An apparatus and related method for forming a double hem in a textile web includes a first scroll which folds the margin inwardly and then outwardly positioning the margin between the first hem and the web. The apparatus relaxes the first hem and a second scroll and a guide wire cooperate to form a second hem which is in alignment with the first hem.

8 Claims, 3 Drawing Sheets

DOUBLE HEM APPARATUS AND METHOD

BACKGROUND OF INVENTION

The present invention relates generally to apparatus for sewing and more particularly to a double hem apparatus and method for forming a double hem in a continuous textile web.

Despite extensive developments in the field of sewing apparatus, there remains a need for an apparatus which can form a double hem in a continuous textile web in a rapid and cost effective manner to facilitate securing the double hem with a single row of stitches.

OBJECTS AND SUMMARY OF INVENTION

It is an object of the present invention to provide a double hem apparatus which can form a double hem in a continuous textile web.

Another object of the present invention is to provide a double hem apparatus which forms a double hem which can be secured by a single row of stitches.

Another object of the present invention is to provide a method for forming a double hem in a textile web in a rapid and efficient manner.

Another object of the present invention is to provide a double hem apparatus which can operate for long periods of time in a reliable manner.

Yet another object of the present invention is to provide a double hem apparatus which includes a relatively small number of component parts resulting in a relatively low overall cost.

The foregoing and other objects and advantages of the present invention will appear more fully hereinafter.

In accordance with the present invention, there is provided a double hem apparatus which includes a feed apparatus which feeds a web in a downstream direction and a first scroll which forms a "b"-shaped channel. The first scroll includes a guide wire which guides the web. The first scroll receives the web and folds the margin of the web inwardly to form a first hem. A relaxation portion is positioned downstream from the first scroll and a second scroll is positioned downstream from the relaxation portion.

The relaxation portion receives the web from the first scroll and relaxes the first hem. The second scroll receives the relaxed first hem and directs the first hem outwardly and then inwardly thereby forming a second hem.

The second hem is aligned above the first hem enabling a single row of stitching to close both hems.

BRIEF DESCRIPTION OF THE DRAWINGS

Other important objects and advantages of the present invention will be apparent from the following detailed description, taken in conjunction with an accompanying drawings in which.

DETAILED DESCRIPTION OF THE INVENTION

Figure 1:
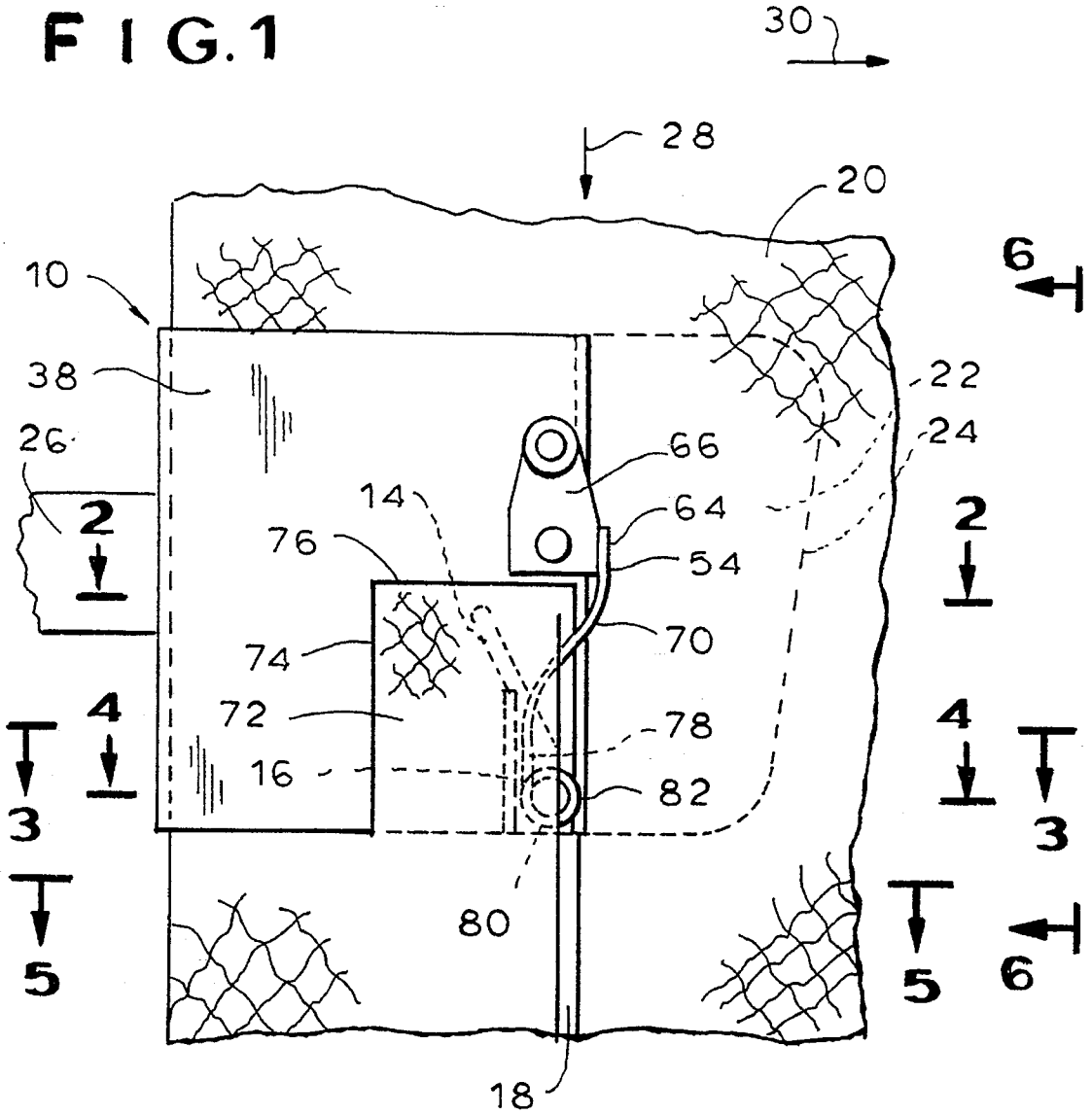
FIG. 1 is a top view of a double hem apparatus, made in accordance with the present invention, with the apparatus shown in use forming a double hem in a continuous textile web.

With reference to the drawings, wherein like reference numbers designate like or corresponding parts throughout, there is shown in FIGS. 1–4 a double hem apparatus 10 made in accordance with the present invention which includes a first scroll 12, a relaxation portion 14 and a second scroll 16. FIG. 1 shows the double hem apparatus 10 in use forming a double hem 18 in a continuous textile web 20.

The first scroll 12 is formed as a continuous portion of the support plate 22, which is shown in broken lines 24 in FIG. 1. The support plate 22 positions the textile web 20 in a generally horizontal orientation. The support plate 22 is mounted on a bracket 26. The textile web 20 is advanced in a downstream direction as indicated by the arrow 28 and is urged outwardly as indicated by the arrow 30 in FIG. 1 by conventional web means which are not shown.

The terms "inwardly" and "outwardly" in this Application are intended to represent directions in which the margin of the web is moved with respect to the center of the web.

The support plate 22 supports a portion 32 of web 20, the margin 34 of which enters "b"-shaped channel 36 which is formed by guide portions 38, 40, 42 of the first scroll 12.

Figure 2:
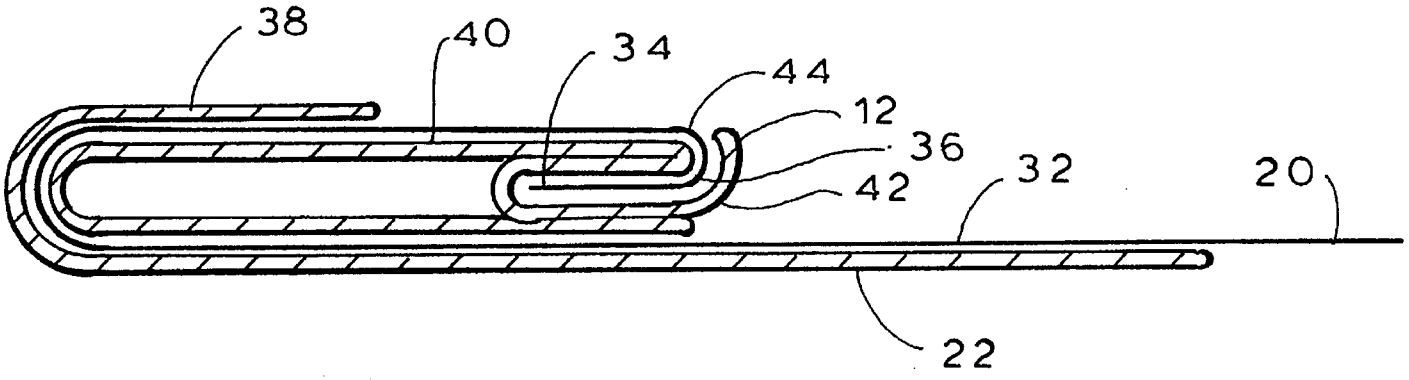
FIG. 2 is a cross-sectional view taken along line 2—2 of FIG. 1.

As is shown in FIG. 2, the margin 34 of web 20 is folded inwardly to form a first hem 44 and the first hem 44 is spaced away from web 20 by guide portions 40, 42. As is also shown in FIG. 2, the margin 34 terminates within the first hem 44.

Figure 3:
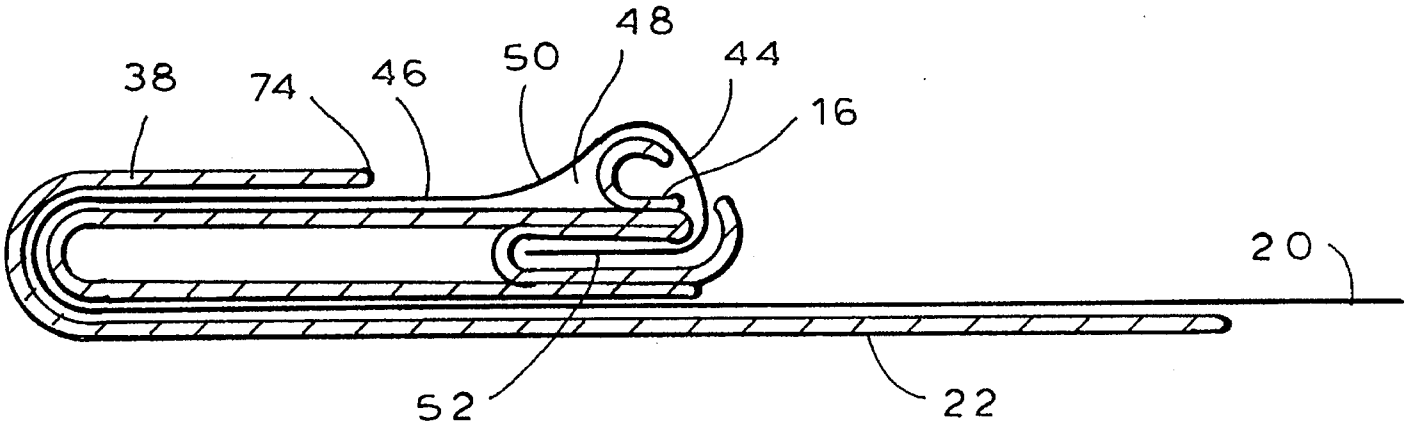
FIG. 3 is a cross-sectional view taken along line 3—3 of FIG. 1.

As web 20 moves in the downstream direction 28, the relaxation portion 14 and the second scroll 16 which are positioned on surface 46 of guide portion 40 enters the first hem 44 as is shown in FIG. 3 and relaxes the first hem 44 thereby forming a space 48 between portions 50, 52 of the first hem 44. The second scroll 16 has the general shape of the letter "C".

Figure 4:
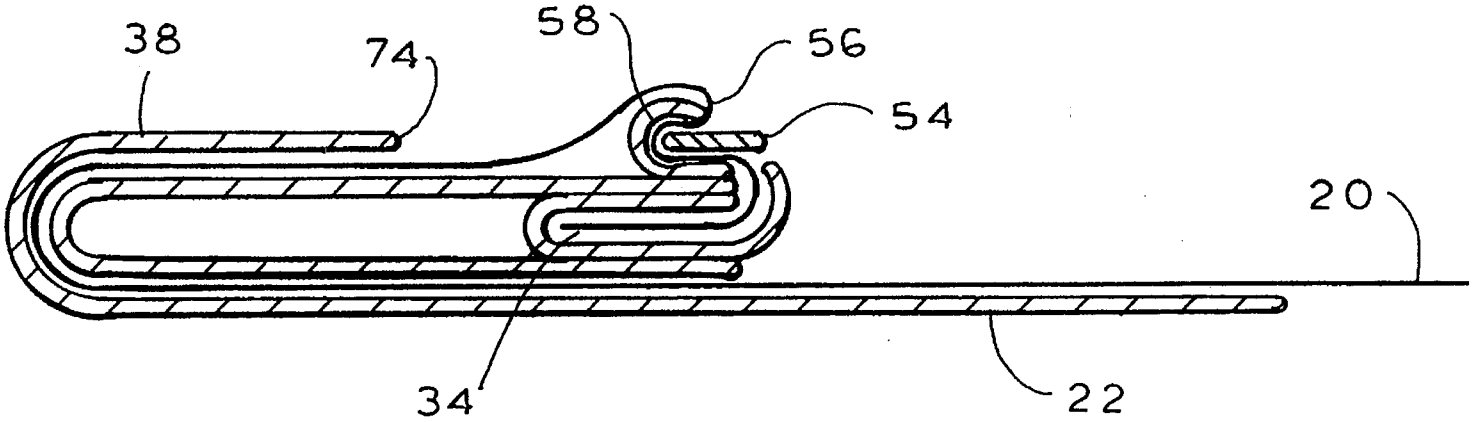
FIG. 4 is a cross-sectional view taken along line 4—4 of FIG. 1.
Figure 5:
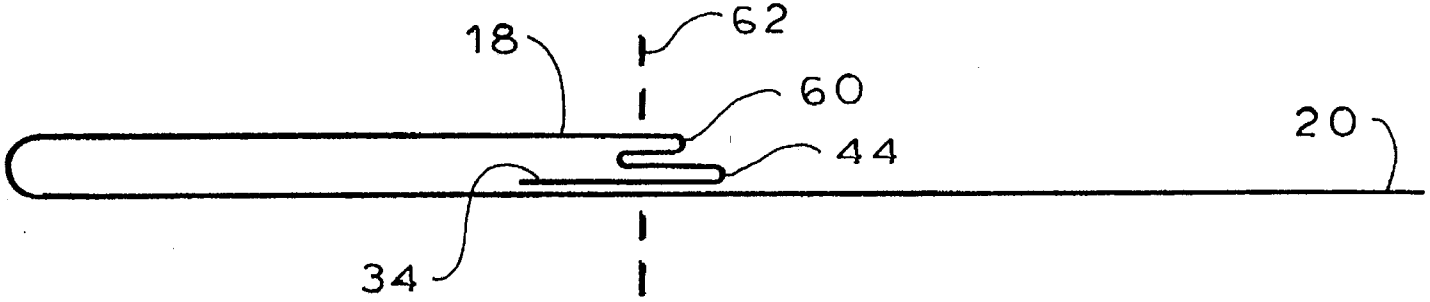
FIG. 5 is a cross-sectional view of a web on which a double hem has been formed by the apparatus of FIG. 1 with the web shown removed from the apparatus and with the double hem shown secured by a single line of stitching.

As web 20 continues to move in the downstream direction 28, a guide wire 54 bears on web 20 as is shown in FIG. 4 forcing a portion 56 of web 20 inwardly and a portion 58 of the web 20 outwardly, thereby forming a second hem 60. The second hem 60 is disposed in general alignment with the first hem 44. The first and second hems 44, 60 can be secured or closed by a single row of stitches which is indicated symbolically by the line 62 in FIG. 5.

The guide wire 54 has a first end 64 which is secured by welding or brazing to a bracket 66 which is mounted on the surface 68 of the first scroll 12. An inclined intermediate portion 70 of the guide wire 54 projects downwardly through an aperture 72 which is formed by the edges 74, 76 of guide portion 38.

The guide wire 54 has a portion 78 which is generally parallel to the second scroll 16 and the end 80 of guide wire 54 is formed as a generally circular loop 82. The portion 78 of the guide wire 54 is disposed relatively close to the second scroll 16 as is shown in FIG. 4. The shape of wire 54 and especially inclined intermediate portion 70 and the portion 78 provides a spring-like characteristic which enables guide wire 54, in cooperation with the second scroll 16, to form the second hem 60 in web 20 without snagging or otherwise damaging web 20 even though web 20 is advancing at a substantial rate of speed.

Figure 6:
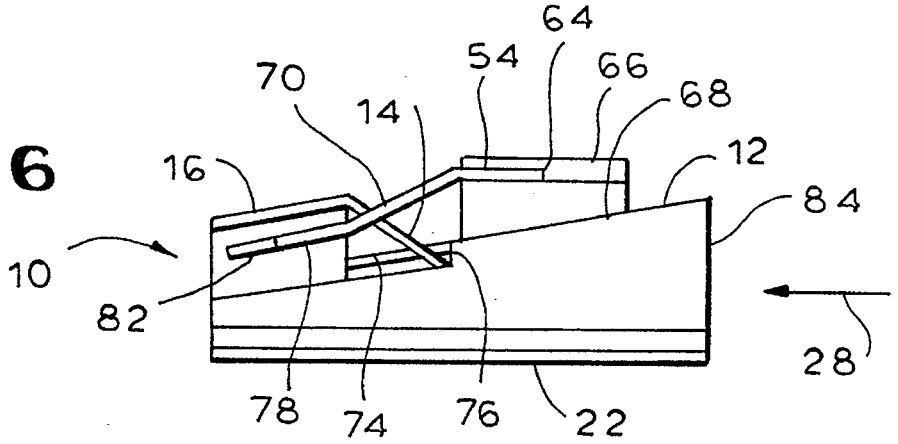
FIG. 6 is a side elevational view of the double hem apparatus of FIG. 1 taken along line 6—6 of FIG. 1.

The first and second scroll portions 12, 16 are formed with smooth transition portions and as is best shown in FIG. 6, the first scroll 12 converges in the downstream direction 28 to facilitate the relaxation of first hem 14. The entrance edge 84 as well as all of the surfaces of the apparatus 10 are smoothly finished to prevent damage to web 20.

The present invention provides a method for forming a double hem which includes the steps of: positioning a textile web 20 horizontally, advancing the web in a downstream direction 28 while simultaneously urging the margin 34 of the web 20 in an outward direction 30; folding the margin 34 of the web 20 inwardly to form a first hem 44; folding the margin 34 outwardly to position the margin 34 between the first hem 44 and the web 20, with the margin 34 terminating within the first hem 44 relaxing the first hem 44; and directing the first hem 44 outwardly and then inwardly over itself to form a second hem 60.

The foregoing specific embodiment of the present invention, as set forth in the specification, is for illustrative purposes only. Various changes and modifications may be made within the spirit and scope of this invention.

I claim:

1. Apparatus for forming a double hem on a continuous margin of a textile web, the apparatus comprising:

feed means for advancing the web in a downstream directing while urging the web also in an outward direction;

a first scroll forming a "b"-shaped channel adapted to receive the web from the feed means and fold the margin inwardly to form a first hem spaced from the web and then to fold the margin outwardly for positioning the margin between the first hem and the web, whereby the margin terminates within the first hem;

relaxation means downstream from the first scroll for relaxing the first hem; and a second scroll spaced from a central member to define a "C"-shaped channel adapted to receive the relaxed first hem and direct that first hem outwardly and then turn it inwardly over itself, whereby a doubled second hem is formed.

2. The apparatus as claimed in claim 1, with the first scroll and the second scroll positioned relative to each other for alignment of the doubled second hem over the first hem, whereby a single row of stitching closes both the hems.

3. The apparatus as claimed in claim 2, with the first scroll converging in the downstream direction to serve as the relaxation means.

4. The apparatus as claimed in claim 3, with the web positioned horizontally.

5. The apparatus as claimed in claim 4, with:

the first scroll including a core forming an inner wall of the "b"-shaped channel;

a guide member connected to the core and the "C"shaped scroll to guide the first hem therein; and the central member centrally depending from thee first scroll.

6. A method for forming a double hem in the margin of a continuous textile web comprising the steps:

advancing the web in a downstream direction while simultaneously urging the web in an outward direction;

folding the margin of the web inwardly to form a first hem;

folding the margin outwardly to position the margin between the first hem and the web, with the margin terminating within the first hem;

relaxing the first hem; and directing the first hem outwardly and then inwardly over itself to form a second hem.

7. A method according to claim 6, after the step of directing the first hem outwardly and then inwardly, further comprising the step:

securing the first and second hems with a single row of stitches.

8. A method according to claim 6, before the step of advancing the web, further comprising the step:

positioning the web horizontally.

* * * * *